US008894045B2

(12) United States Patent
Mizutani et al.

(10) Patent No.: US 8,894,045 B2
(45) Date of Patent: Nov. 25, 2014

(54) LIQUID CONTAINER AND LIQUID EJECTING APPARATUS

(75) Inventors: Tadahiro Mizutani, Shiojiri (JP); Izumi Nozawa, Matsumoto (JP); Hiroyuki Nakamura, Shiojiri (JP); Hidetoshi Kodama, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 839 days.

(21) Appl. No.: 13/075,150

(22) Filed: Mar. 29, 2011

(65) Prior Publication Data

US 2011/0241231 A1 Oct. 6, 2011

(30) Foreign Application Priority Data

Mar. 30, 2010 (JP) ..... 2010-077484

(51) Int. Cl.
*B01F 3/04* (2006.01)
*B41J 2/175* (2006.01)

(52) U.S. Cl.
CPC ..... *B41J 2/17513* (2013.01); *B41J 2/17596* (2013.01); *B41J 2002/17516* (2013.01); *B41J 2/17556* (2013.01)
USPC ..... 261/72.1; 347/86

(58) Field of Classification Search
USPC ..... 261/72.1; 347/85, 86
See application file for complete search history.

(56) References Cited

U.S. PATENT DOCUMENTS

| | | | | |
|---|---|---|---|---|
| 5,812,155 | A * | 9/1998 | Seccombe | 347/6 |
| 7,004,575 | B2 * | 2/2006 | Inoue et al. | 347/86 |
| 8,474,959 | B2 * | 7/2013 | Nozawa et al. | 347/86 |
| 2003/0035036 | A1 | 2/2003 | Ogura et al. | |
| 2003/0067520 | A1 | 4/2003 | Inoue et al. | |
| 2003/0122909 | A1 | 7/2003 | Ogura et al. | |
| 2004/0223036 | A1 | 11/2004 | Inoue et al. | |
| 2005/0264624 | A1 | 12/2005 | Ogura et al. | |
| 2008/0036828 | A1 | 2/2008 | Koike et al. | |
| 2009/0079804 | A1 | 3/2009 | Kimura | |

FOREIGN PATENT DOCUMENTS

| | | | |
|---|---|---|---|
| EP | 2085226 | A2 | 8/2009 |
| JP | 2003-191488 | A | 7/2003 |
| JP | 2003-251826 | A | 9/2003 |
| JP | 4144842 | B2 | 6/2008 |

* cited by examiner

*Primary Examiner* — Charles Bushey
(74) *Attorney, Agent, or Firm* — Kilpatrick Townsend & Stockton LLP

(57) ABSTRACT

A liquid container which contains liquid to be supplied to a liquid ejecting apparatus, includes: a containing section which contains liquid and includes a liquid delivery section, an air introduction section, and a deformation section, wherein the deformation section includes a rigid body section and a flexible section, the liquid container further includes a stop section which at least blocks the displacement equal to or greater than a predetermined amount with respect to a portion of the rigid body section, and in displacement of the rigid body section accompanying a reduction in the pressure, the air introduction section introduces the air into the containing section by transmission of displacement of the other portion of the rigid body section, the displacement of the portion of which has been blocked.

19 Claims, 5 Drawing Sheets

U
100
101
1101
1102
110
20
111
130a
130b
140
113
150
145
154
152
151
153
Pp
Ap
Sc, G
160
Ps1
Ps2
180
115
116
112
132
102
114
A0
A1
170
171
120
120a
p1
p2
p3
p4
p5
L12
PH
PB
PM
PL
IIB
IIC
IV

LIQUID CONTAINER AND LIQUID EJECTING APPARATUS

This application claims priority to Japanese Patent Application No. 2010-077484, filed Mar. 30, 2010, the entirety of which is incorporated by reference herein.

BACKGROUND

1. Technical Field

The present invention relates to a liquid container which contains liquid to be supplied to a liquid ejecting apparatus.

2. Related Art

In the past, as a system of a liquid container which contains liquid to be supplied to a liquid ejecting apparatus, there has been a semi-hermetically-sealed type. In a semi-hermetically-sealed type liquid container, at least a portion of a liquid containing space is constituted by a member having flexibility, for example, a sheet. The sheet is deformed in accordance with the consumption of liquid, so that the liquid containing space is reduced. Then, the inside of the liquid containing space is maintained at negative pressure by a spring which pushes up the flexible sheet against contraction. As a result, when the liquid ejecting apparatus does not consume liquid, liquid does not flow out from the liquid container to the liquid ejecting apparatus side.

At the semi-hermetically-sealed type liquid container, an air inlet for introducing air into the liquid containing space is provided. Then, at a point in time when the sheet is deformed, whereby the liquid containing space is reduced to some extent, a valve of the air inlet is opened, so that air is introduced into the liquid containing space. As a result, the liquid containing space slightly increases by the amount of introduced air. At the same time, the negative pressure in the liquid containing space slightly decreases (becomes closer to atmospheric pressure). Thereafter, in the semi-hermetically-sealed type liquid container, a movement is repeated in which in accordance with consumption of liquid, negative pressure is increased by the spring which pushes up the flexible sheet and every time the air inlet is opened, the negative pressure is slightly decreased (becomes closer to atmospheric pressure). As a result, a negative pressure stable within a certain range can be realized until the use of the liquid container is ended, except for a time immediately after the start of use of the liquid container. As a result, the amount of unused liquid remaining in the liquid container also becomes small compared to a hermetically-sealed type.

For example, in an ink containing container of Japanese Patent No. 4144842, a movable member 11 as a sheet having a planar shape of a rectangle is attached at four sides thereof to a frame 18 which forms a rectangular ring. Further, a planar plate 14 is attached to the movable member 11. Then, the planar plate 14 is displaced with respect to the frame 18 with the deformation of the movable member 11 which is a sheet. A spring 43 provided in a storage space supports the planar plate 14 at one point and pushes up the planar plate 14 along with the movable member 11 which is a sheet. On the other hand, when the negative pressure of the storage space has increased to be equal to or more than a predetermined value, outside air is introduced through a ventilation portion 1. In the technology of Japanese Patent No. 4144842, a function as the above-described semi-hermetically-sealed type liquid container is realized by these operations.

JP-A-2003-191488 and JP-A-2003-251826 are other examples of the related art.

However, in the technology of Japanese Patent No. 4144842, the planar plate 14 is supported at the outer circumference thereof on the movable member 11 which is a sheet, and further pressed by the spring 43 at one point. For this reason, at the time of displacement accompanying a reduction in ink, the planar plate 14 is not displaced with a constant position always maintained with respect to the frame 18, but can be displaced with it inclined in various positions. For this reason, in a case where the liquid container is provided with a mechanism which performs a given operation on the basis, for example, of the position of the planar plate 14, the operation of the mechanism is not stable.

Also, since the planar plate 14 can be displaced with it inclined in various positions, the shape of the storage space can be variously changed in the above-mentioned operation of repeating an increase in negative pressure and introduction of outside air. For this reason, the liquid level of ink in the storage space does not also maintain the tendency of a reduction within a certain variation range, but largely increases or decreases in accordance with the position of the planar plate 14. Accordingly, in a case where the liquid container is provided with a mechanism which performs a given operation on the basis, for example, of the position of the liquid level of ink, the operation of the mechanism is not stable.

That is, in the technology of Japanese Patent No. 4144842, since the planar plate 14 can take various positions in the liquid container, in a case where the liquid container is provided with a mechanism which performs a given operation on the basis of the state of the inside of the liquid container, the operation thereof is not stable. Such a problem does not occur only in the liquid storage container, but widely occurs in a semi-hermetically-sealed liquid container in which a change in volume is induced by deforming a member having flexibility.

SUMMARY

An advantage of some aspects of the invention is, in a liquid container in which a change in volume is induced by deforming a member having flexibility, to make a change in the state of the inside of the liquid container be stably performed and make a mechanism which operates on the basis of the state of the inside of the liquid container stably operate.

The invention can be implemented as the following modes and applications.

Application 1

According to an aspect of the invention, there is provided a liquid container which contains liquid to be supplied to a liquid ejecting apparatus, the container including:

a containing section which contains liquid and includes a liquid delivery section for delivering the liquid to the outside, an air introduction section for introducing external air into the containing section, and a deformation section which constitutes a portion of the outer circumference of the containing section and is capable of being deformed, wherein the deformation section includes:

a rigid body section which is not deformed by a reduction in pressure in the inside of the containing section, and a flexible section which is deformed with a reduction in pressure in the inside of the containing section due to the delivery of the liquid, thereby allowing the rigid body section to be displaced in a direction in which the capacity of the containing section is reduced, the liquid container further includes a stop section which at least blocks the displacement equal to or greater than a predetermined amount with respect to a portion of the rigid body section, and in the displacement of the rigid body section accompanying a reduction in the pressure, displacement of the other portion of the rigid body section, in which the displacement has been blocked with respect to the portion, is transmitted to the air introduction section, whereby the air introduction section introduces the air into the containing section.

According to such an aspect, in the rigid body section, after displacement of a portion is blocked by the stop section, while the position of the portion is not changed, the other portion is displaced. Then, the displacement is transmitted to the air introduction section, so that air is introduced into the containing section. For this reason, in the above-described aspect, compared to an aspect in which displacement is not blocked even with respect to any area of the rigid body section, the mode of displacement of the rigid body section is stable. Accordingly, it is possible to make the air introduction section, which operates on the basis of the state of the inside of the liquid container, stably operate.

Application 2

In the liquid container according to Application 1, the stop section may be configured so as to at least block the displacement equal to or more than the predetermined amount with respect to two points of the rigid body section as the portion of the rigid body section.

According to such an aspect, in the rigid body section, after displacement of two points is blocked by the stop section, the rigid body section rotates around the two points while the positions of the two points are not changed. Then, displacement of the other portion of the rigid body section by the rotation is transmitted to the air introduction section, so that air is introduced into the containing section. For this reason, in the above-described aspect, compared to an aspect in which displacement is not blocked even with respect to any area of the rigid body section, the mode of displacement of the rigid body section is stable. Accordingly, it is possible to make the air introduction section, which operates on the basis of the state of the inside of the liquid container, stably operate.

In addition, the expression, a rigid body section "is not deformed by a reduction in pressure in the inside of the containing section", means that the rigid body section is not deformed compared to the flexible section which is deformed with a reduction in pressure in the inside of the containing section. That is, the expression, a rigid body section "is not deformed by a reduction in pressure in the inside of the containing section", does not intend to require that the rigid body section is entirely not deformed by a reduction in pressure in the inside of the containing section.

Application 3

The liquid container according to Application 2 may further include:

a wall portion which constitutes the outer circumference of the containing section along with the deformation section, wherein the stop section is provided at the wall portion and provided so as to come into contact with the two points prior to another area of the rigid body section when the two points have been displaced by a predetermined amount, in the displacement of the rigid body section accompanying a reduction in the pressure.

According to such a configuration, it is possible to accurately limit the displacement of the rigid body section to the wall portion which constitutes the outer circumference of the containing section.

Application 4

In the liquid container according to Application 2, the stop section may be provided to protrude in the direction of the displacement from the two points of the rigid body section.

Also in such a configuration, it is possible to block displacement equal to or greater than a predetermined amount with respect to the two points of the rigid body section.

Application 5

In the liquid container according to any one of Applications 2 to 4, the rigid body section may be in the form of a plate, and the rigid body section, the stop section, and the air introduction section may be configured such that the center of gravity of the rigid body section is located in a triangle which is configured by an area of the rigid body section, which comes into contact with another member in order to transmit the displacement to the air introduction section, and the two points.

A force which displaces the plate-like rigid body section in accordance with a reduction in pressure can be regarded as acting on the center of gravity of the plate-like rigid body section. For this reason, according to the aspect as described above, it is possible to effectively transmit a force which displaces the rigid body section to the air introduction section with two points which limit a change in position of the plate-like rigid body section as fulcrums.

Application 6

The liquid container according to Application 5 may further include:

an elastic member which biases the rigid body section in a direction in which the capacity of the containing section increases, wherein the stop section is configured to block the displacement equal to or greater than a predetermined which is greater than 0 with respect to the two points, and the rigid body section, the stop section, and the elastic member are configured such that the center of gravity of the rigid body section is on the same side as the two points with respect to the center of an area where the elastic member biases the rigid body section.

A force which displaces the plate-like rigid body section in accordance with a reduction in pressure can be regarded as acting on the center of gravity of the plate-like rigid body section. For this reason, according to the aspect as described above, an area on the two-point side, where displacement is blocked, of the plate-like rigid body section is displaced larger than the area where the elastic member biases the rigid body section. For this reason, displacement of the two points is blocked at an early stage by the stop section. As a result, it is possible to regulate displacement of the rigid body section in the early stage of displacement of the rigid body section.

In addition, the expression, "being on the same side as two points (where displacement is blocked) with respect to the center of an area where the rigid body section is biased", means that it is on the same side as the two points where displacement is blocked, with respect to a straight line passing the center of the area where the rigid body section is biased, which is a straight line parallel to the straight line passing two points where displacement is blocked.

Application 7

The liquid container according to any one of Applications 2 to 6 may further include:

a detection member for detecting a liquid level of the liquid having fallen below the height of a predetermined detection position, at the predetermined detection position in the containing section when the liquid container is in a state where it is mounted on the liquid ejecting apparatus, wherein the rigid body section, the stop sections, and the detection member are configured such that when the liquid container is in a state where it is mounted on the liquid ejecting apparatus, the detection position and the two points are located below an area of the rigid body section, which comes into contact with another member in order to transmit the displacement to the air introduction section, and the detection position is at a position closer to the two points than the area of the rigid body section, which comes into contact with another member, in the height direction.

According to such an aspect, the detection position and the two points of the rigid body section are immersed in liquid up to a position behind an area of the rigid body section, which comes into contact with another member in order to transmit the displacement to the air introduction section when liquid is reduced in the containing section. Also, the detection position of the detection member is disposed at a position closer to two points where displacement is blocked than the area of the rigid body section, which is displaced in order to transmit displacement to the air introduction section. For this reason, it is difficult for the capacity of the containing section from the detection position down to be changed by displacement of the rigid body section. Therefore, at a point in time when the detection member detects the liquid level of liquid having fallen below the height of the detection position, it is difficult for the amount of liquid remaining in the containing section to be changed by a deformation mode of the deformation section. In other words, according to the aspect as described above, the amount of liquid remaining in the containing section being below a certain value can be accurately detected by the detection member.

Also, the distance between a certain point P and the two points where displacement is blocked is set to be evaluated by the length of a perpendicular line drawn from the point P to a straight line passing the two points where displacement is blocked.

Application 8

In the liquid container according to Application 7 limiting Application 6, the rigid body section, the stop section, the elastic member, and the detection member may be configured such that when the liquid container is in a state where it is mounted on the liquid ejecting apparatus, the detection position and the two points are located below the center of the area where the elastic member biases the rigid body section.

In such an aspect, both the two points where displacement is limited and the detection position are below an area of the plate-like rigid body section, which is biased and displaced by the elastic member. For this reason, it is difficult for the capacity below the detection position of the containing section to be affected by displacement of the rigid body section. Accordingly, according to the above aspect, it is possible to stably perform detection of the liquid level by the detection member.

Application 9

In the liquid container according to Application 6, a first elastic member and a second elastic member in which an elastic force that is exerted on the rigid body section in the same displacement is smaller than that of the first elastic member may be provided as the elastic member, wherein the second elastic member biases the rigid body section at a position closer to the two points than the first elastic member.

In such an aspect, when the two points of the rigid body section are in a state where displacement is not limited and the inside of the containing section is in a predetermined decompression state, an area of the rigid body section, which is biased by the second elastic member, is displaced larger than an area which is biased by the first elastic member. For this reason, if decompression proceeds, displacement of the two points can be blocked in an early stage by the stop section. As a result, it is possible to regulate displacement of the rigid body section in the early stage of displacement of the rigid body section.

Application 10

According to this application, there is provided a liquid ejecting apparatus including the liquid container according to any one of Applications 2 to 9.

In addition, the invention can be implemented in various aspects as described below:

(1) A liquid container, a liquid supply device, and a liquid supply method.

(2) An ink container and an ink supply device.

(3) A liquid consumption apparatus and an ink jet printer.

BRIEF DESCRIPTION OF THE DRAWINGS

The invention will be described with reference to the accompanying drawings, wherein like numbers reference like elements.

FIG. 5 is a plan view representing the shape of a pressure receiving plate according to Modified Example 1 of the pressure receiving plate or the like.

FIG. 6 is a plan view representing the shape of a pressure receiving plate according to Modified Example 2 of the pressure receiving plate or the like.

FIG. 7 is a plan view representing the aspect of a pressure receiving plate according to Modified Example 3 of the pressure receiving plate or the like.

DESCRIPTION OF EXEMPLARY EMBODIMENTS

A. Example

(1) Configuration of Printer

Figure 1:
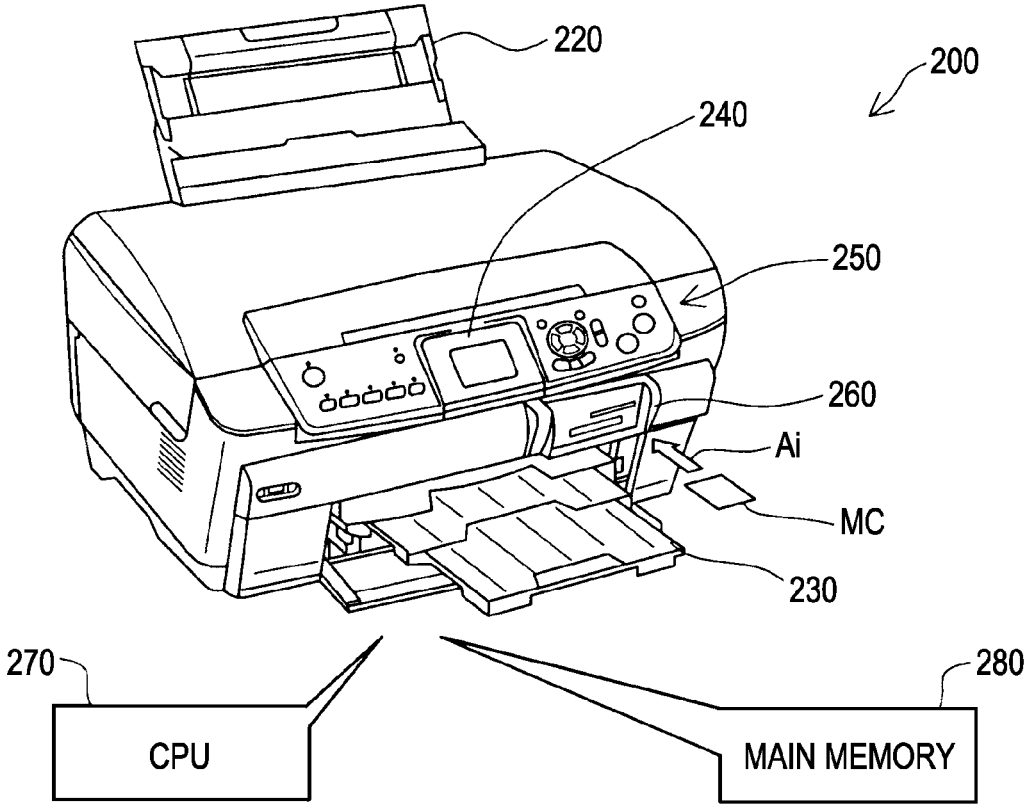
FIG. 1 is a perspective view showing a printer according to an example of the invention.

FIG. 1 is a perspective view showing a printer 200 according to an example of the invention. The printer 200 is a printer which can independently performs printing on the basis of an image data file stored in a storage medium without being connected to an external computer. The printer 200 includes a printing head (not shown) which performs printing by discharging ink droplets while reciprocating along with a carriage, an automatic sheet feeder 220 for supplying printing paper, a paper discharge tray 230 which receives the printing paper with an image printed thereon, a liquid crystal display 240, a button group 250 for performing various operations, a card slot 260 into which a memory card is inserted, thereby reading data, a CPU 270, and a main memory 280.

Into the card slot 260, a memory card MC such as a Compact Flash (registered trademark) card, an SD card, a mini-SD card, a memory stick, or a smart-media card can be directly inserted or the memory card can be inserted through an adapter (refer to an arrow Ai in FIG. 1). Then, the CPU 270 can obtain the image data file stored in the memory card MC through the card slot 260. The CPU 270 executes printing on the basis of the image data file.

(2) Configuration of Ink Cartridge

Figures 2A, 2B, 2C:
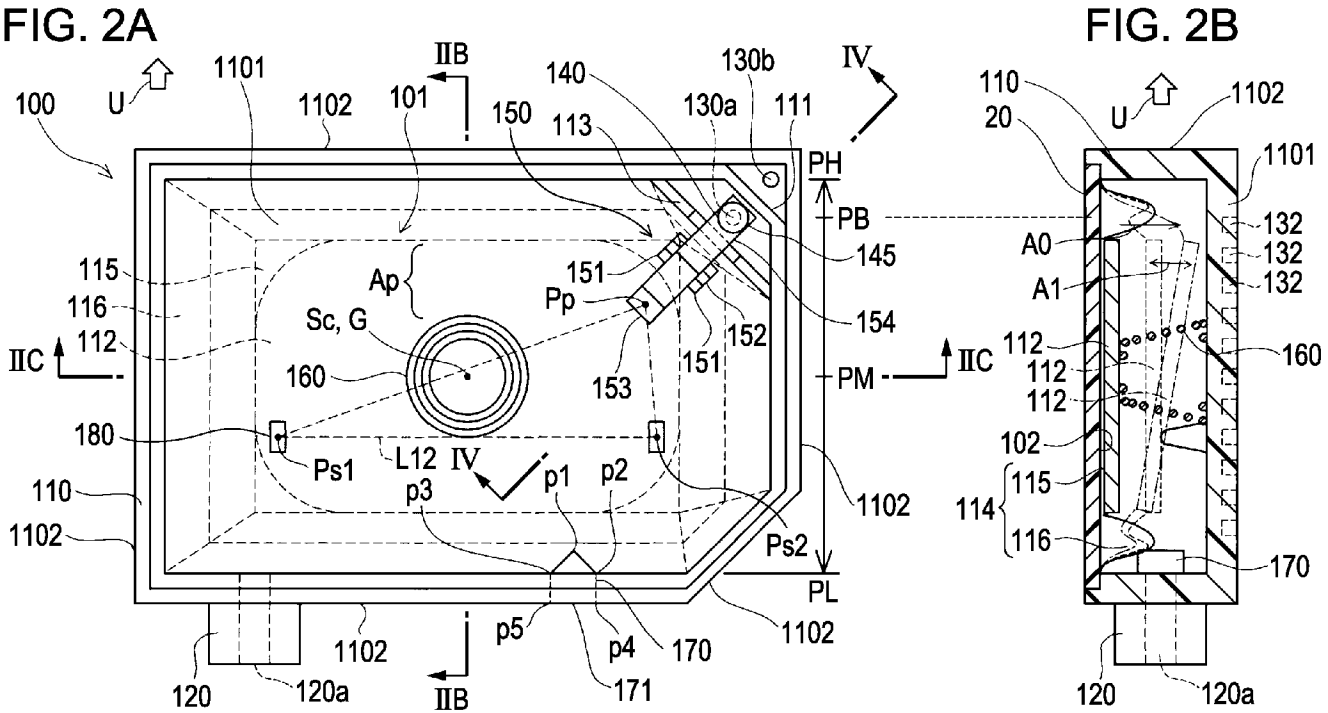
FIGS. 2A to 2C are a plan view and cross-sectional views of an ink cartridge according to an example.

FIGS. 2A to 2C are a plan view and cross-sectional views of an ink cartridge 100 which is mounted on the carriage of the printer 200 and supplies ink to the printing head. FIG. 2A is a plan view, FIG. 2B is a cross-sectional view taken along the line IIB-IIB of FIG. 2A, and FIG. 2C is a cross-sectional view taken along the line IIC-IIC of FIG. 2A. In addition, in order to facilitate understanding of the technology, in each cross-sectional view, a portion of the configuration which would be visible at the back of the cross section is omitted.

The ink cartridge 100 includes a bathtub-shaped container main body 110, and a cover member 20 which is combined with the container main body 110. The container main body 110 has a bottom portion 1101 and side walls 1102 which surround an approximately rectangular parallelepiped shape, more precisely, a void with a hexagonal column shape. The cover member 20 is a plate-like member which is combined with the container main body 110, thereby sealing the void of the container main body 110, and constitutes an outer shell of the ink cartridge 100 which is an approximately rectangular parallelepiped. The container main body 110 and the cover member 20 are formed of, for example, a synthetic resin such as polypropylene (PP) or polyethylene (PE). In addition, in the plan view of FIG. 2A, in order to facilitate the understanding of the technology, a state where the cover member 20 and some other members are removed from the ink cartridge 100 is shown.

The void of the approximately rectangular parallelepiped of the container main body 110 is sealed by a film 114 having flexibility. The film 114 includes a plane portion 115 having a planar shape in a state where it does not receive an external force, and a bend portion 116 which is provided around the plane portion 115 and is folded back in a state where it does not receive an external force. The outer shape of the plane portion 115 is an approximate quadrangle, as shown by a broken line in FIG. 2A. The outer circumference of the bend portion 116 is welded to the upper end portions of the side walls 1102 of the container main body 110, as shown in FIGS. 2B and 2C. For this reason, the film 114 first falls from the upper ends of the side walls 1102 of the container main body 110 toward the bottom portion 1101 and is then reversed in a direction away from the bottom portion 1101, leading to the central plane portion 115.

Ink is contained in a space which is defined by the film 114 and the container main body 110. On the other hand, air is contained in a space 102 between the film 114 and the cover member 20. A structure which is mainly constituted by the film 114 and the container main body 110 and contains ink is called an "ink containing section 101". The capacity of the ink containing section 101 varies with the extension or folding-back of the bend portion 116 of the film 114 constituting a portion of the outer circumference of the ink containing section 101 and displacement of the plane portion 115 constituting a portion of the outer circumference of the ink containing section 101 in the same way. In addition, the container main body 110 constituting a portion of the outer circumference of the ink containing section 101 is not deformed.

A coil spring 160 having a truncated conical shape is disposed approximately at the center of the bottom portion 1101 of the container main body 110. The coil spring 160 supports a pressure receiving plate 112 at the other end thereof. The pressure receiving plate 112 has approximately the same shape as that of the plane portion 115 of the film 114. That is, the pressure receiving plate 112 is of an approximate quadrangle slightly smaller than the plane portion 115. However, the pressure receiving plate 112 has a shape in which each of four vertexes of a quadrangle is replaced by a circular arc. The coil spring 160 supports the center of gravity G of the pressure receiving plate 112. That is, the center Sc of a circular portion where the coil spring 160 supports the pressure receiving plate 112 and the center of gravity G of the planar shape of the pressure receiving plate 112 correspond with each other. The pressure receiving plate 112 is pressed toward the plane portion 115 and the cover member 20 by the coil spring 160 at a position where it overlaps with the plane portion 115 of the film 114. That is, the coil spring 160 biases the pressure receiving plate 112 in a direction in which the capacity of the ink containing section 101 increases.

A pair of stop sections 180 and 180 is provided at the bottom portion 1101 of the container main body 110 and at a position on the side wall 1102 side with respect to the coil spring 160. The stop sections 180 and 180 are projections which protrude toward the plane portion 115 and the pressure receiving plate 112. In a position when the ink cartridge 100 is mounted on and used in the printer 200, the stop sections 180 and 180 are located below the coil spring 160.

If ink in the ink containing section 101 is consumed such that the volume occupied by ink is reduced, negative pressure is generated such that the pressure receiving plate 112 and the plane portion 115 of the film 114 are drawn toward the bottom portion 1101 (refer to an arrow A0 in FIGS. 2B and 2C). The position of the pressure receiving plate 112 after the ink is consumed is shown by a broken line and a dashed-dotted line in FIGS. 2B and 2C. As shown in these drawings, the film 114 is deformed in accordance with a change in pressure in the ink containing section 101, whereas the pressure receiving plate 112 is not substantially deformed even if pressure in the ink containing section 101 varies. However, the pressure receiving plate 112 is displaced with the deformation of the film 114. In addition, in this specification, "displacement" is a concept which includes parallel movement, rotation, and combined movement of the parallel movement and the rotation.

Figure 3:
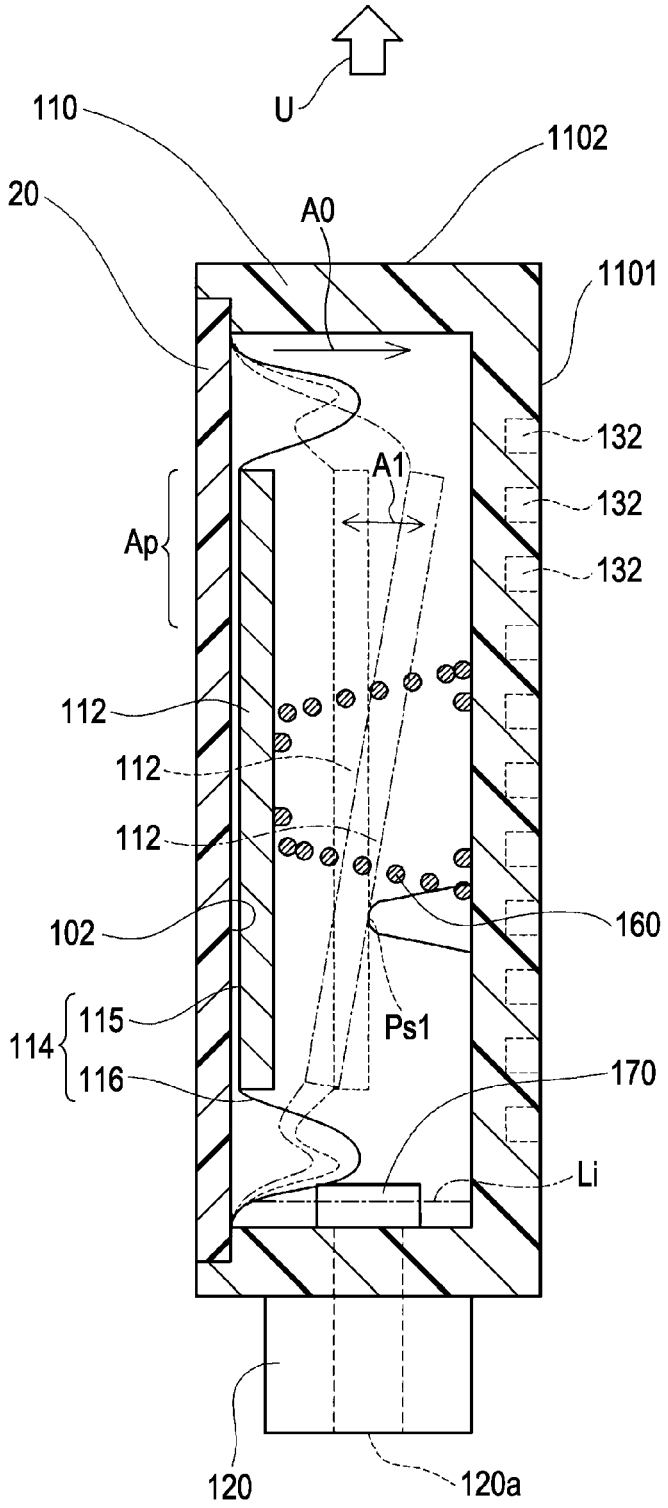
FIG. 3 is an enlarged view of the cross section shown in FIG. 2B.

FIG. 3 is an enlarged view of the cross section shown in FIG. 2B. If the pressure receiving plate 112 is drawn by a given amount toward the bottom portion 1101 due to a reduction in pressure in the ink containing section 101, two points Ps1 and Ps2 of the pressure receiving plate 112 respectively come into contact with the stop sections 180 and 180 (refer to FIGS. 2A and 3). Then, further displacement of the two points Ps1 and Ps2 of the pressure receiving plate 112 can be blocked by the stop sections 180 and 180.

Thereafter, if pressure in the ink containing section 101 is further reduced, while the two points Ps1 and Ps2 keep their positions, the pressure receiving plate 112 rotates toward the bottom portion 1101 with a straight line connecting the two points Ps1 and Ps2 as an axis (refer to an arrow A1). As a result, a portion Ap on the side opposite to the two points Ps1 and Ps2 with the portion supported by the coil spring 160 interposed therebetween is drawn toward the bottom portion 1101.

As shown in FIGS. 2A to 2C and 3, at the side wall 1102 of the container main body 110, an ink supply section 120 is provided which includes a supply hole 120*a* for supplying ink to the printing head of the ink jet printer 200 as a liquid consumption apparatus. Also, a hole opened to the atmosphere 130*a* for introducing external air into the ink containing section 101 is provided at the bottom portion 1101 of the container main body 110 and in the vicinity of a corner portion at a position on the side opposite to the supply hole 120*a* with the coil spring 160 interposed therebetween (refer to FIG. 2A). The hole opened to the atmosphere 130*a* is provided at a position which does not overlap with the pressure receiving plate 112 in the case of projecting the pressure receiving plate 112 in the expansion and contraction direction of the coil spring 160, that is, the displacement direction A0 of the pressure receiving plate 112.

When the ink cartridge 100 is used, the ink cartridge 100 is mounted in a position in which the ink supply section 120 is located on the lowest side and a position in which two sides of the ink cartridge 100, which is an approximately rectangular parallelepiped, become almost horizontal. At this time, the hole opened to the atmosphere 130*a* is at a position PB above a middle position PM between a position PL of the lowermost portion and a position PH of the uppermost portion of the void in the ink containing section 101. In this example, this position PB is at a position within 10% from the position PH, among positions between the position PL and the position PH. In this position, the pressure receiving plate 112 is located below the hole opened to the atmosphere 130*a* (refer to FIGS. 2A and 2B).

A wall section 113 is provided at the bottom portion 1101 of the container main body 110 and in the vicinity of a corner portion at a position on the side opposite to the supply hole 120*a* with the coil spring 160 interposed therebetween. The hole opened to the atmosphere 130*a* is provided at the side opposite to the coil spring 160 with the wall section 113 interposed therebetween. A transmission arm 150 is provided at the bottom portion 1101 of the container main body 110 and at a position facing the hole opened to the atmosphere 130*a* across the wall section 113.

Figure 4:
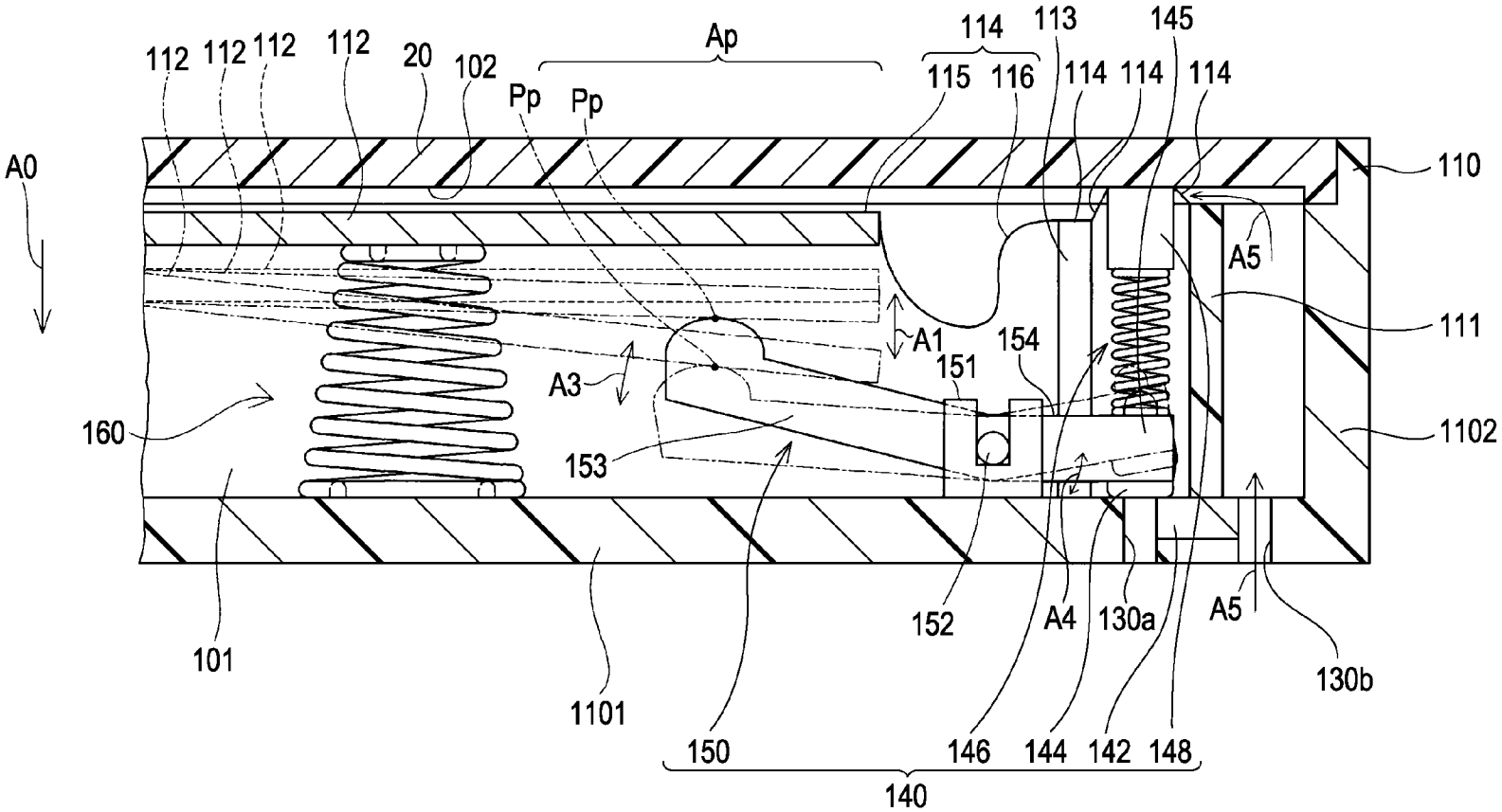
FIG. 4 is a cross-sectional view of the ink cartridge in the vicinity of a transmission arm.

FIG. 4 is a cross-sectional view of the ink cartridge 100 in the vicinity of the transmission arm 150. FIG. 4 is a cross-sectional view taken along the line IV-IV of FIG. 2A. The transmission arm 150 has arm portions 153 and 154 which make an obtuse angle with each other with a fulcrum 152 as the center. Approximately at the center of the wall section 113, a slit is provided comparatively lower than other provided portions. The arm portion 154 of the transmission arm 150 reaches above the hole opened to the atmosphere 130*a* beyond the slit. On the other hand, the arm portion 153 of the transmission arm 150 extends up to a position where the leading end thereof overlaps with the pressure receiving plate 112 in the case of projecting the pressure receiving plate 112 in a direction in which the pressure receiving plate 112 is displaced (refer to FIG. 2A). The transmission arm 150 is supported by a pair of support sections 151 at the fulcrum 152 and is rotatable around the fulcrum 152 within a predetermined range (refer to arrows A3 and A4 in FIG. 4). The fulcrum 152 and the arm portions 153 and 154 of the transmission arm 150 are formed of a synthetic resin such as polypropylene (PP) or polyethylene (PE).

A leading end portion 145 of the arm portion 154 of the transmission arm 150 is pressed toward the hole opened to the atmosphere 130*a* side of the bottom portion 1101, that is, the outside of the container main body 110 by a coil spring 146. The other end of the coil spring 146 is supported on the cover member 20 through a spring seat 148. At the side of the leading end portion 145 of the arm portion 154, which faces the hole opened to the atmosphere 130*a*, an annular seal portion 144 is provided. The seal portion 144 is formed of, for example, elastomer. The leading end portion 145 of the arm portion 154 is pressed against a portion 142, which defines the outer circumference of the hole opened to the atmosphere 130*a* of the bottom portion 1101, by the coil spring 146, whereby the hole opened to the atmosphere 130*a* is sealed by the annular seal portion 144. That is, the hole opened to the atmosphere 130*a* is sealed.

If the pressure receiving plate 112 is displaced, so that the two points Ps1 and Ps2 come into contact with the stop sections 180 and 180, and the portion Ap of the pressure receiving plate 112 is then drawn toward the bottom portion 1101, thereby reaching a given position (refer to the pressure receiving plate 112 indicated by a two-dot chain line in FIG. 4), the leading end of the arm portion 153 of the transmission arm 150 comes into contact with one point Pp of the pressure receiving plate 112. Then, if the portion Ap of the pressure receiving plate 112 further moves down, the leading end of the arm portion 153 is pushed down by the pressure receiving plate 112 (refer to the pressure receiving plate 112 and the arm portion 153 indicated by a dashed-dotted line in FIG. 4). Then, the arm portion 154 which is on the opposite side across the fulcrum 152 moves up, so that the seal portion 144 is separated from the portion 142 of the bottom portion 1101, whereby the hole opened to the atmosphere 130*a* is opened.

The center Sc of the portion that the coil spring 160 supports, and the center of gravity G of the planar shape of the pressure receiving plate 112 are in the inside of a triangle which is configured by one point Pp of the pressure receiving plate 112, which comes into contact with the leading end of the arm portion 153, and two points Ps1 and Ps2 of the pressure receiving plate 112, which come into contact with the stop sections 180 and 180. In addition, strictly, one point Pp of the pressure receiving plate 112, which comes into contact with the leading end of the arm portion 153, moves on the surface of the pressure receiving plate 112 in accordance with the displacement of the pressure receiving plate 112. However, in the following description, in order to facilitate the understanding of the technology, a spot of the pressure receiving plate 112, which comes into contact with the leading end of the arm portion 153, is uniformly described as one point Pp.

In addition, the portion 142 defining the outer circumference of the hole opened to the atmosphere 130*a* in the bottom portion 1101, the seal portion 144, the transmission arm 150, the coil spring 146, and the spring seat 148 serve to open and close the hole opened to the atmosphere 130*a*. These elements, the portion 142 of the bottom portion 1101, the seal portion 144, the transmission arm 150, the coil spring 146, and the spring seat 148, are collectively called an "air introduction section 140".

On the other hand, as shown in FIG. 2A, at the side wall 1102 where the ink supply section 120 is provided, a prism 170 for detecting the liquid level of ink having fallen below a predetermined position is provided. When the ink cartridge 100 is used, the ink cartridge 100 is mounted in a position in which the ink supply section 120 and the prism 170 are located on the lowest side and a position in which two outer walls of the ink cartridge 100, which is an approximately rectangular parallelepiped, become almost horizontal.

The prism 170 is of an approximately pentagonal prism shape having an axis in a displacement direction (refer to the arrow A0) of the pressure receiving plate 112 before coming into contact with the stop sections 180 and 180. The pentagonal cross-section of the prism 170 in a plane perpendicular to the displacement direction A0 of the pressure receiving plate 112 has one vertex p1 having an inner angle of 90 degrees, two vertexes p2 and p3 which are disposed with the vertex p1 interposed therebetween and each have an inner angle of an obtuse angle, two other vertexes p4 and p5 each having an inner angle of 90 degrees.

An approximately triangular prismatic portion defined by the vertexes p1 to p3 in the prism 170 is exposed to the inside of the ink containing section 101. For this reason, when ink is present to be equal to or greater than a predetermined amount in the ink containing section 101, a face extending between the vertex p1 and the vertex p2 and a face extending between the vertex p1 and the vertex p3 come into contact with ink. On the other hand, a face 171 extending between the vertex p4 and the vertex p5 is exposed to the outer surface of the ink cartridge 100.

In a state where the ink cartridge 100 is not used, ink sufficient to make the leading end portion (refer to the vertexes p1 to p3) of the prism 170 be buried beneath the liquid level of ink is present. For this reason, light emitted from an optical sensor provided at the printer 200 toward the exposed face 171 of the prism 170 is absorbed into ink in the ink containing section 101 at the leading end portion (refer to the vertexes p1 to p3) of the prism 170. Accordingly, the amount of reflected light which is received by the optical sensor is less than a predetermined value.

Thereafter, if a state is created where ink is consumed, whereby the liquid level of ink is lowered up to a level Li shown by a dashed line in FIG. 3, a portion of the leading end portion (refer to the vertexes p1 to p3) of the prism 170 comes into contact with air in the ink containing section 101. For this reason, light emitted from the optical sensor is reflected at the leading end portion (refer to the vertexes p1 to p3) of the prism 170 and the optical sensor receives the reflected light. That is, the amount of light which is received by the optical sensor is equal to or more than a predetermined value. Accordingly, the printer 200 can detect the liquid level of ink having fallen below a predetermined position, that is, the amount of ink remaining being below a predetermined amount, on the basis of the amount of light which is received by the optical sensor.

In this example, in a state where the ink cartridge 100 is mounted on the printer 200, the leading end portion (refer to the vertexes p1 to p3) of the prism 170 is below the area Pp of the pressure receiving plate 112, which comes into contact with the leading end of the arm portion 153 of the transmission arm 150 (refer to FIG. 2A). Further, the leading end portion (refer to the vertexes p1 to p3) of the prism 170 is at a position closer to a straight line L12 extending between the contact points Ps1 and Ps2 of the pressure receiving plate 112 with the stop sections 180 and 180 than the area Pp of the pressure receiving plate 112. For this reason, when consumption of ink has progressed, ink remaining in the ink containing section 101 is in the vicinity of the leading end portion of the prism 170. Then, in the region, it is difficult for the range thereof in the ink containing section 101 to vary due to the displacement of the pressure receiving plate 112 accompanying the consumption of ink (refer to the vicinity of the liquid level Li and the vicinity of the area Ap of the pressure receiving plate 112 in FIG. 3). For this reason, when the liquid level of ink having fallen below a predetermined position Li has been detected by the prism 170, variation in the amount of ink remaining in the ink cartridge 100 is small. In addition, the distance between a certain point P and a certain straight line L is evaluated by the length of a perpendicular line drawn from the point P to the straight line L.

Also, the leading end portion (refer to the vertexes p1 to p3) of the prism 170 is below the center Sc of the circular portion of the pressure receiving plate 112, which is displaced by the coil spring 160. Accordingly, also in this respect, in a region where the prism 170 detects the liquid level of the remaining ink, it is difficult for the range thereof in the ink containing section 101 to vary due to the displacement of the pressure receiving plate 112 by the coil spring 160. For this reason, when the liquid level of ink having fallen below a predetermined position Li has been detected by the prism 170, variation in the amount of ink remaining in the ink cartridge 100 is small.

As shown in FIG. 2A, a wall section 111 is provided at the bottom portion 1101 of the container main body 110 and outside the hole opened to the atmosphere 130*a*. The wall section 111 constitutes the outer circumference of the ink containing section 101 along with the bottom portion 1101 of the container main body 110, a portion of the side wall 1102, and the film 114. That is, a portion of the outer circumference of the film 114 is welded to the upper end of the wall section 111. Then, the outside (the side opposite the side where the hole opened to the atmosphere 130*a* is present) of the wall section 111 is not the ink containing section 101.

A ventilation hole 130*b* is provided at the bottom portion 1101 of the container main body 110 and at a position facing the hole opened to the atmosphere 130*a* across the wall section 111. The ventilation hole 130*b* is a configuration for introducing external atmosphere into the space 102 between the film 114 and the cover member 20 (refer to an arrow A5 in FIG. 4). By such a configuration, when pressure in the ink containing section 101 has been reduced, the plane portion 115 of the film 114 or the pressure receiving plate 112 can be displaced in a direction away from the cover member 20 and toward the bottom portion 1101.

A serpentine flow path 132 is provided at a portion on the side opposite (the right side in FIG. 2B and the lower side in FIG. 2C) to the ink containing section 101 in the bottom portion 1101. The serpentine flow path 132 is constituted by a groove portion provided in a zigzag manner in the bottom portion 1101 and a sheet overlaid on the groove portion. The serpentine flow path 132 communicates with the hole opened to the atmosphere 130*a* and the ventilation hole 130*b* in the vicinity of one end thereof. Then, the other end of the serpentine flow path 132 is opened to the atmosphere.

Through a configuration in which the hole opened to the atmosphere 130*a* and the ventilation hole 130*b* are connected to the outside through the serpentine flow path 132 without being directly opened to the outside, it is possible to reduce the possibility of a solvent of ink in the ink containing section 101 evaporating, whereby the viscosity of ink increases or that ink may be oxidized, while allowing introduction of outside air into the ink containing section 101 or the space 102.

(3) Operation of Ink Cartridge

In a state where the ink cartridge 100 is not used, the plane portion 115 of the film 114 remains pushed toward the cover member 20 through the pressure receiving plate 112 by the coil spring 160. That is, the space 102 between the film 114 and the cover member 20 is in the minimum state. In this state, the inside of the ink containing section 101 which is constituted by the film 114 and the container main body 110 is filled with ink (refer to the cross-sectional views of FIGS. 2B and 2C and FIG. 4). That is, air is not present in the ink containing section 101.

When the ink cartridge 100 is used, the ink cartridge 100 is mounted in a position in which the ink supply section 120 and the prism 170 are located on the lowest side and a position in which two sides of the ink cartridge 100 that is an approximately rectangular parallelepiped become almost horizontal (refer to FIGS. 2A and 2B). That is, the ink cartridge 100 is mounted in a position in which a direction indicated by an arrow U in FIGS. 2A and 2B becomes a vertically upward direction.

Thereafter, if ink is delivered from the supply hole 120*a*, ink in the ink containing section 101 decreases. In this state, the hole opened to the atmosphere 130*a* remains sealed by the seal portion 144 of the leading end of the arm portion 154. Also, the coil spring 160 tries to push up the pressure receiving plate 112 and the film 114. For this reason, the volume of ink in the ink containing section 101 decreases, whereas the capacity of the ink containing section 101 decreases almost not at all, and pressure in the ink containing section 101 is reduced.

On the other hand, the space 102 between the film 114 and the cover member 20 communicates with the outside through the ventilation hole 130*b* and the serpentine flow path 132. For this reason, pressure in the space 102 is maintained at atmospheric pressure. As a result, the plane portion 115 of the film 114 and the pressure receiving plate 112 is pressed toward the ink containing section 101 side, in which pressure is lower, by the pressure of air in the space 102, thereby being displaced in a direction indicated by the arrow A0. Then, the plane portion 115 and the pressure receiving plate 112 stop at a position where the reactive force of the coil spring 160, which increases in accordance with an increase in the displacement, and a force caused by a difference in pressure between the space 102 and the ink containing section 101, which decreases in accordance with an increase in the displacement, are balanced.

As ink is consumed, the plane portion 115 and the pressure receiving plate 112 approach the bottom portion 1101 until the pressure receiving plate 112 comes into contact with the stop sections 180 and 180 (refer to the arrow A0 in FIGS. 2B, 2C, and 4).

If ink in the ink cartridge 100 is consumed, so that the pressure receiving plate 112 reaches a position where it comes into contact with the stop sections 180 and 180 (refer to the pressure receiving plate 112 indicated by a broken line in FIG. 3), the two points Ps1 and Ps2 of the pressure receiving plate 112 are prevented from being further displaced toward the bottom portion 1101. Thereafter, if ink in the ink cartridge 100 is further consumed, while the positions of the two points Ps1 and Ps2 are maintained, the pressure receiving plate 112 rotates toward the bottom portion 1101 with a straight line connecting the two points Ps1 and Ps2 as an axis (refer to the arrow A1). As a result, the portion Ap on the side opposite to the two points Ps1 and Ps2 with the portion supported by the coil spring 160 interposed therebetween is drawn toward the bottom portion 1101.

Thereafter, if ink in the ink cartridge 100 is further consumed, so that the portion Ap (more precisely, the spot Pp) of the pressure receiving plate 112 reaches below a position where it comes into contact with the arm portion 153 (refer to the pressure receiving plate 112 indicated by a dashed-dotted line in FIG. 4), as described above, the arm portion 153 is pushed down by the pressure receiving plate 112, so that the arm portion 154 is lifted up, whereby the hole opened to the atmosphere 130*a* is opened (refer to the arm portions 153 and 154 indicated by a dashed-dotted line in FIG. 4). Then, outside air is introduced from the hole opened to the atmosphere 130*a* into the ink containing section 101. Then, if the inside of the ink containing section 101 is under atmospheric pressure, since the difference in pressure between the space 102 and the ink containing section 101 becomes 0, the pressure receiving plate 112 and the plane portion 115 of the film 114 are pushed up by the force of the coil spring 160. As a result, a restriction on the arm portion 153 is removed. On the other hand, the arm portion 154 is pressed toward the hole opened to the atmosphere 130*a* of the bottom portion 1101 by the coil spring 146. For this reason, the leading portion (more specifically, the seal portion 144) of the arm portion 154 is pushed back to the hole opened to the atmosphere 130*a*, so that the hole opened to the atmosphere 130*a* is sealed. At this time, the pressure receiving plate 112 is pushed back up to a position indicated by a two-dot chain line in FIG. 4 or a position slightly higher than that.

In addition, air introduced into the ink containing section 101 is gathered on the upper side (refer to the arrow U in FIGS. 2A to 2C and 3) inside the ink containing section 101. On the other hand, the hole opened to the atmosphere 130*a* is disposed at the upper position PB in the ink containing section 101. For this reason, the hole opened to the atmosphere 130*a* is located above the liquid level of ink in an early stage since air started to be introduced into the ink containing section 101. Accordingly, the possibility of ink leaking from the hole opened to the atmosphere 130*a* is low compared to an aspect where the hole opened to the atmosphere 130*a* is below the middle position PM.

Thereafter, if ink is further consumed, so that the portion Ap of the pressure receiving plate 112 reaches below a position where it comes into contact with the arm portion 153, the above-described operation is repeated. As a result, the plane portion 115 of the film 114 and the pressure receiving plate 112 repeat reciprocating rotational movement with a straight line connecting the two points Ps1 and Ps2, which come into contact with the stop sections 180 and 180, as an axis, as shown by the arrow A1 in FIGS. 2A to 2C and 4. At this time, the nearer the portion Ap of the pressure receiving plate 112 is located to a position near the bottom portion 1101, the lower the pressure in the ink containing section 101, and the further the portion Ap of the pressure receiving plate 112 is located from position far at the bottom portion 1101, the higher the pressure in the ink containing section 101. However, pressure in the ink containing section 101 is maintained within a range between atmospheric pressure and a given pressure less than atmospheric pressure. As a result, ink can be stably supplied from the supply hole 120*a* to the ink jet printer. In addition, when the ink cartridge 100 is in a position when it is used, in a state before the pressure receiving plate 112 comes into contact with the stop sections 180 and 180, a displacement direction (the arrow A0) of the pressure receiving plate 112 is a horizontal direction (refer to FIG. 2B).

In the above configuration, since the pressure receiving plate 112 is provided, it is possible to evenly transmit the force of the coil spring 160 to the film 114 through the pressure receiving plate 112. Also, it is possible to stably transmit a force caused by a difference in pressure between the space 102 and the ink containing section 101 to the arm portion 153 of the transmission arm 150 through the pressure receiving plate 112.

Also, in the above configuration, since the stop sections 180 and 180 are provided, if ink is consumed, the pressure receiving plate 112 first comes into contact with the stop sections 180 and 180 at the two points Ps1 and Ps2, thereby being supported, and then performs reciprocating rotational movement with a straight line connecting the two points Ps1 and Ps2 as an axis (refer to FIG. 3). Then, in the reciprocating rotational movement, when the portion Ap of the pressure receiving plate 112 is drawn by an amount equal to or greater than a predetermined amount toward the bottom portion 1101, the hole opened to the atmosphere 130*a* is opened. For this reason, it is possible to maintain an almost constant position of the pressure receiving plate 112 when the hole opened to the atmosphere 130*a* is opened. Accordingly, compared to an aspect where the position of a pressure receiving plate can variously vary stochastically, in this example, it is possible to maintain an almost constant timing when the hole opened to the atmosphere 130*a* is opened. In other words, it is possible to make the air introduction section 140 stably operate.

In addition, the ink containing section 101 (the container main body 110 and the film 114) in this example is equivalent to the "containing section" in the "Summary". The ink supply section 120 is equivalent to the "liquid delivery section". The air introduction section 140 (the portion 142 of the bottom portion 1101, the seal portion 144, the transmission arm 150, the coil spring 146, and the spring seat 148) is equivalent to the "air introduction section". The pressure receiving plate 112 and the film 114 are equivalent to the "deformation section".

The pressure receiving plate 112 is equivalent to the "rigid body section". The film 114 is equivalent to the "flexible section". The stop sections 180 and 180 are equivalent to the "stop section". The two points Ps1 and Ps2 of the pressure receiving plate 112 are equivalent to the "two points of the rigid body section".

The bottom portion 1101 and the wide walls 1102 in this example are equivalent to the "wall portions" in the "Summary". The coil spring 160 is equivalent to the "elastic member". The prism 170 is equivalent to the "detection member". An area where an approximately triangular prismatic portion defined by the vertexes p1 to p3 of the prism 170 is located is equivalent to the "detection position".

B. Modified Example of Configuration of Pressure Receiving Plate and its Periphery In the above-described example, the pressure receiving plate 112 is plate shaped and has an approximately rectangular planar shape having four corners of circular arcs. Then, the coil spring 160 supports the pressure receiving plate 112 such that the center Sc of the circle of the coil and the center of gravity G of the pressure receiving plate 112 correspond with each other (refer to Sc and G in FIGS. 2A to 2C). However, with respect to the shape of the pressure receiving plate and an aspect in which the coil spring 160 supports the pressure receiving plate, it is also possible to adopt other aspects.

Figure 5:
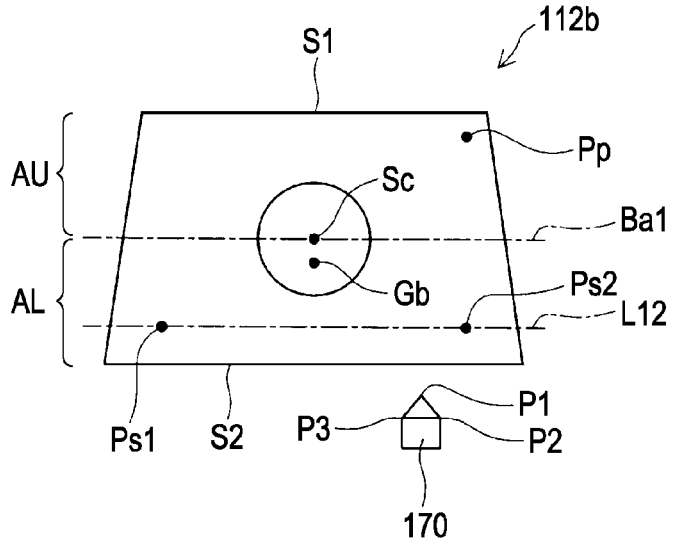

B1. Modified Example 1 of Configuration of Pressure Receiving Plate and its Periphery FIG. 5 is a plan view representing the shape of a pressure receiving plate 112*b* according to Modified Example 1 of the pressure receiving plate or the like. In FIG. 5, the same reference numeral as that described in FIGS. 2A to 4 represents the same object as that in FIGS. 2A to 4. The pressure receiving plate 112*b* is of an approximately trapezoidal shape, in which a side S1 located on the upper side is shorter than a side S2 located on the lower side to be parallel to the side S1, in a position when the ink cartridge 100 is mounted on and used in the printer 200. Then, the center of gravity Gb of the pressure receiving plate 112*b* is below the center Sc of the circular portion where the coil spring 160 supports the pressure receiving plate 112*b*. The other respects of the pressure receiving plate 112*b* are the same as those of the pressure receiving plate 112 of the example. In addition, in FIG. 5, the portion where the coil spring 160 supports the pressure receiving plate 112*b* is represented by a circle around the center Sc.

In a position when the ink cartridge 100 is mounted on and used in the printer 200, the respective points of the pressure receiving plate 112*b* are arranged in order of one point Pp of the pressure receiving plate 112*b*, which comes into contact with the leading end of the arm portion 153, the center Sc of the circular portion which is supported by the coil spring 160, the center of gravity Gb, and the contact points Ps1 and Ps2 with the stop sections 180 and 180, in sequence from above. Then, the leading end portion (refer to the vertexes p1 to p3) of the prism 170 is located further below the contact points Ps1 and Ps2.

Also in such an aspect, if ink in the ink containing section 101 is consumed, the pressure receiving plate 112*b* performs reciprocating rotational movement with the straight line L12 connecting the two points Ps1 and Ps2 as an axis. For this reason, the air introduction section 140 which is operated by the displacement of the pressure receiving plate 112*b* which is transmitted thereto can stably operate. Further, also in such an aspect, the prism 170 is disposed at a position closer to the contact points Ps1 and Ps2, where displacement is limited, than the area Pp of the pressure receiving plate 112*b*, which is largely displaced and comes into contact with the leading end of the arm portion 153. For this reason, it is possible to accurately detect the amount of ink remaining in the ink containing section 101 being below a predetermined amount.

Also, in the pressure receiving plate 112*b*, the area of a portion AL which is located on the contact points Ps1 and Ps2 side (the lower side) across the center Sc of the circular portion which is supported by the coil spring 160 is larger than the area of a portion AU which is located on the opposite side (the upper side) to the contact points Ps1 and Ps2. For this reason, the lower portion A1 of the pressure receiving plate 112*b* is displaced larger than the upper portion AU in accordance with a reduction in pressure in the ink containing section 101. As a result, the two points Ps1 and Ps2 at an early stage come into contact with the stop sections 180 and 180. Thereafter, the pressure receiving plate 112*b* stably performs a rotational operation with the straight line L12 connecting the two points Ps1 and Ps2 as an axis. Therefore, according to the pressure receiving plate 112*b*, it is possible at an early stage to make the air introduction section 140 stably operate. In addition, in FIG. 5, the boundary between the upper portion AU and the lower portion AL of the pressure receiving plate is indicated by a straight line Ba1. The straight line Ba1 is a straight line passing the point Sc in parallel with the straight line L12 passing the contact points Ps1 and Ps2.

Figure 6:
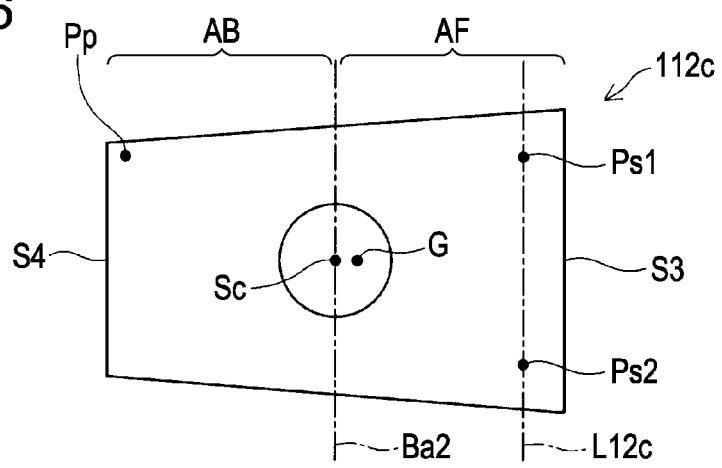

B2. Modified Example 2 of Configuration of Pressure Receiving Plate and its Periphery FIG. 6 is a plan view representing the shape of a pressure receiving plate 112*c* and each point on the pressure receiving plate 112*c* according to Modified Example 2 of the pressure receiving plate or the like. In FIG. 6, the same reference numeral as that described in FIGS. 2A to 5 represents the same object as that in FIGS. 2A to 5. The pressure receiving plate 112*c* is of an approximately trapezoidal shape, in which a vertical side S3 on the side close to the prism 170 is longer than a vertical side S4 on the side far from the prism 170 and parallel to the side S3, in a position when the ink cartridge 100 is mounted on and used in the printer 200. Then, the center of gravity Gc of the pressure receiving plate 112*c* is further on the side S3 side than the center Sc of the circular portion where the coil spring 160 supports the pressure receiving plate 112*c*.

In addition, in this modified example, in a position when the ink cartridge 100 is mounted on and used in the printer 200, the air introduction section 140 is above the coil spring 160 and at a position closer to the side S4 than the side S3 of the pressure receiving plate 112*c*. As a result, one point Pp of the pressure receiving plate 112*c*, which comes into contact with the leading end of the arm portion 153 of the air introduction section 140, is also above the center Sc of the portion which is supported by the coil spring 160 and at a position closer to the side S4 than the side S3.

Also, in a position when the ink cartridge 100 is mounted on and used in the printer 200, the stop sections 180 and 180 are provided at the side opposite to the air introduction section 140 with the coil spring 160 interposed therebetween in a horizontal direction. That is, the stop sections 180 and 180 are at positions closer to the side S3 than the side S4 of the pressure receiving plate 112*c*. As a result, two points Ps1 and Ps2 of the pressure receiving plate 112*c*, which come into contact with the stop sections 180 and 180, are also between the center Sc of the portion which is supported by the coil spring 160 and the side S3.

In a position when the ink cartridge 100 is mounted on and used in the printer 200, the respective points of the pressure receiving plate 112*c* are arranged in order of one point Pp of the pressure receiving plate 112*c*, which comes into contact with the leading end of the arm portion 153, the center Sc of the circular portion which is supported by the coil spring 160, the center of gravity Gc, the leading end portion (refer to the vertexes p1 to p3) of the prism 170, and the contact points Ps1 and Ps2 with the stop sections 180 and 180, in sequence from the side S4 toward the S3.

With respect to configurations other than each respect described above, the configuration of the pressure receiving plate 112*c* is the same as that of the pressure receiving plate 112 of the example. With respect to configurations other than each respect described above, the configuration of the ink cartridge 100 is also the same as that of the ink cartridge 100 of the example.

Also in such aspect, similarly to the pressure receiving plate 112, it is possible to make the air introduction section 140 stably operate. Also, it is possible to precisely detect the amount of ink remaining in the ink containing section 101 being below a predetermined amount.

Also, in the pressure receiving plate 112*c*, the area of a portion AF which is located on the contact points Ps1 and Ps2 side and the prism 170 side across the center Sc of the circular portion which is supported by the coil spring 160 is larger than the area of a portion AB which is located on the contact point Pp side. For this reason, the portion AF of the pressure receiving plate 112*c* is displaced larger than the portion AB on the other side in accordance with a reduction in pressure in the ink containing section 101. As a result, the two points Ps1 and Ps2 at an early stage come into contact with the stop sections 180 and 180 on the side close to the prism 170. Thereafter, the pressure receiving plate 112*c* stably performs a rotational operation with a straight line connecting the two points Ps1 and Ps2 as an axis. Therefore, according to the pressure receiving plate 112*c*, it is possible at an early stage to make the air introduction section 140 stably operate. Also, according to the pressure receiving plate 112*c*, the volume in the vicinity of the prism 170 in the ink containing section 101 is stabilized at an early stage. Therefore, according to the pressure receiving plate 112*c*, it is possible to accurately detect the amount of ink remaining having become equal to or less than a predetermined value, by using the prism 170 for detecting a position of a liquid level. In addition, in FIG. 6, the boundary between the portion AF and the portion AB of the pressure receiving plate is represented by a straight line Ba2. The straight line Ba2 is a straight line passing the point Sc in parallel with a straight line L12*c* passing the contact points Ps1 and Ps2.

B3. Modified Example 3 of Pressure Receiving Plate

Figure 7:
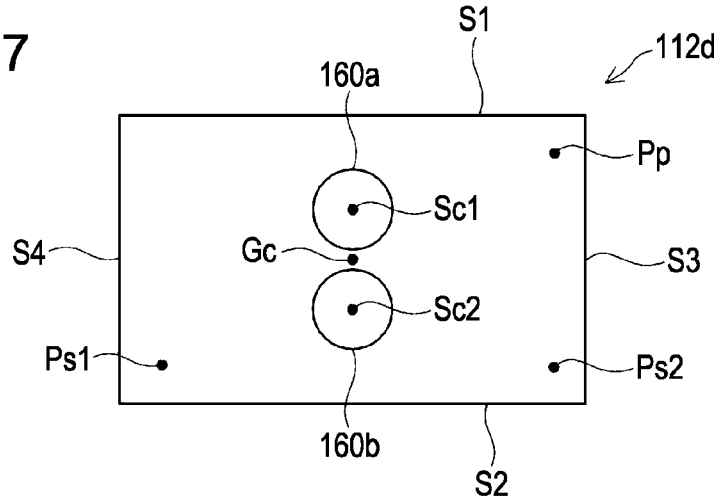

FIG. 7 is a plan view representing the aspect of a pressure receiving plate 112*d* according to Modified Example 3 of the pressure receiving plate or the like. In FIG. 7, the same reference numerals as described in FIGS. 2A to 6 represent the same objects as those in FIGS. 2A to 6. An ink cartridge 100*e* which is provided with the pressure receiving plate 112*d* is provided with two coil springs 160*a* and 160*b*. Then, in a position when the ink cartridge 100*e* is mounted on and used in the printer 200, the pressure receiving plate 112*d* is supported on the two coil springs 160*a* and 160*b*. The coil spring 160*a* supports the side upper than the center of gravity Ge of the pressure receiving plate 112*d* and the coil spring 160*b* supports the side lower than the center of gravity Ge of the pressure receiving plate 112*d*.

In a position when the ink cartridge 100*e* is mounted on and used in the printer 200, the coil spring 160*b* which is located on the lower side has an elastic coefficient smaller than that of the coil spring 160*a*. For this reason, in a case where the pressure receiving plate 112*d* moves in a parallel fashion toward the bottom portion 1101 while the ink cartridge 100*e* maintains a position in a state before it is used, a reactive force by the coil spring 160*b* is smaller than that by the coil spring 160*a*.

Also in such an aspect, similarly to the pressure receiving plate 112, it is possible to make the air introduction section 140 stably operate. Also, it is possible to precisely detect the amount of ink remaining in the ink containing section 101 being below a predetermined amount.

Also, according to the ink cartridge 100*e*, the lower portion of the pressure receiving plate 112*d*, which is supported by the coil spring 160*b*, is displaced larger than the upper portion which is supported by the coil spring 160*a*, in accordance with a reduction in pressure in the ink containing section 101. As a result, the two points Ps1 and Ps2 at an early stage come into contact with the stop sections 180 and 180. Thereafter, the pressure receiving plate 112*d* stably performs a rotational operation with a straight line connecting the two points Ps1 and Ps2 as an axis. Therefore, according to the pressure receiving plate 112*d*, it is possible at an early stage to make the air introduction section 140 stably operate.

C. Modified Examples

C1. Modified Example 1

In the above-described example, the stop sections 180 and 180 which come into contact with the two points Ps1 and Ps2 of the pressure receiving plate 112, thereby limiting the displacement thereof, are convex sections provided at the bottom portion 1101. However, a configuration which comes into contact with the two points Ps1 and Ps2 of the pressure receiving plate 112, thereby limiting the displacement thereof, may be provided at the side wall 1102. That is, it is acceptable if the stop section is provided at a wall portion which constitutes the containing section along with the deformation section and provided so as to come into contact with two points prior to another area of the pressure receiving plate when the two points have been displaced by a predetermined amount, in the displacement of the pressure receiving plate (the rigid body section) accompanying a reduction in pressure.

C2. Modified Example 2

In the above-described example, after the hole opened to the atmosphere 130*a* is opened, the pressure receiving plate 112 repeats reciprocating rotational movement in a state where two points Ps1 and Ps2 are supported on the stop sections 180 and 180. However, an aspect is also possible in which also after the hole opened to the atmosphere 130*a* is opened, the pressure receiving plate 112 moves away from the bottom portion 1101 up to a position away from the stop sections 180 and 180. However, in the aspect in which after the hole opened to the atmosphere 130*a* is opened, the pressure receiving plate 112 repeats a reciprocating rotational movement in a state where two points Ps1 and Ps2 are supported on the stop sections 180 and 180, it is difficult for the relative position of the pressure receiving plate 112 to the stop sections 180 and 180 to be shifted. For this reason, it is possible to further stabilize the state in the ink containing section 101 when supplying ink.

Also, the stop section which limits the displacement of two points of the pressure receiving plate may be configured as one or more convex sections provided so as to protrude in a displacement direction from the pressure receiving plate side. In such an aspect, two points of a base portion of the convex section can be understood as two points where displacement is limited.

In addition, with respect to the stop section, besides a configuration in which a pair of stop sections is provided as in the example, three or more stop sections may be provided or the stop section may also be provided as an integral configuration capable of limiting the displacement of two points of the pressure receiving plate as the rigid body section. As one aspect of the latter, for example, it is possible to adopt a wall-like configuration in which the stop sections 180 and 180 of the example are connected and integrated together. That is, the stop section may be configured to block not only two points, but also the displacement of another point which is a portion of the rigid body section and is on a straight line connecting the two points.

Also, the stop section may be configured to block the displacement of one point of the rigid body section. That is, the stop section may be configured to block the displacement of a portion of the rigid body section. However, it is preferable that the stop section be configured to block the displacement of a linear portion of the rigid body section. Further, it is preferable that the stop section be configured to block the displacement of two points of the rigid body section. In such an aspect, the rigid body section rotates with the above-mentioned linear portion or a straight line, which is defined by the two points, as an axis after the displacement of a portion is blocked.

C3. Modified Example 3

In the above-described example, two points Ps1 and Ps2 of the pressure receiving plate 112 is allowed to be displaced in a range until they come into contact with the stop sections 180 and 180. That is, the allowed amount of displacement is greater than 0. However, an aspect is also possible in which no displacement of two points of the pressure receiving plate 112 is allowed. Such an aspect can be understood as an aspect in which the allowed amount of displacement is 0.

C4. Modified Example 4

In the above-described example, the liquid level of ink is optically detected by using the prism 170. However, the liquid level of ink may be detected by another method such as using a residual vibration with use of a piezoelectric element.

C5. Modified Example 5

In the above-described example, the displacement of the pressure receiving plate 112 is transmitted to the leading end portion 145 and the seal portion 144 by the transmission arm 150 (the arm portions 153 and 154) capable of rotating around the fulcrum 152. However, a configuration to transmit the displacement of the pressure receiving plate 112 to the leading end portion 145 and the seal portion 144 may be made in other aspects. For example, an aspect to transmit the displacement of the pressure receiving plate 112 can also be made not by rotating but using a configuration in which the entirety is displaced, such as parallel movement. Also, an aspect to transmit the displacement of the pressure receiving plate 112 through a link is also possible. In the aspect of the former, it is possible to transmit the displacement of the pressure receiving plate 112 to the leading end portion 145 as displacement in an unchanged direction, or displacement in a different direction in which the angle that it makes with the direction of the above displacement is no more than 90 degrees. In the aspect of the latter, it is possible to convert the direction of displacement of the pressure receiving plate 112 into an arbitrary direction and then transmit the displacement of the pressure receiving plate 112 to the portion 145.

That is, the transmission section may have an aspect to transmit the deformation of the deformation section to a second seal portion in an unchanged direction or an aspect to convert the deformation of the deformation section to a different direction and then transmit it to the second seal portion. Then, it is acceptable if the displacement or the deformation of the pressure receiving plate 112 or the film 114 as the deformation section can be transmitted as displacement or a force to the portion 145 as the second seal portion.

C6. Modified Example 6

In the above-described example, the pressure receiving plate 112 and the plane portion 115 of the film 114 each have an outer shape of an approximate hexagon. However, the pressure receiving plate 112 and the plane portion 115 are not limited to an approximate hexagon, but may be of various shapes. However, it is preferable that they be of a shape convex toward the outside, not a shape having a concave portion like a crescent shape or a star shape. For example, in the case of a polygon, it is preferable that the magnitude of the inner angle of a corner be less than 180 degrees.

C7. Modified Example 7

In the above-described example, in a state before ink is consumed, the pressure receiving plate 112 is biased by the coil spring 160. However, an aspect is also possible in which after ink is consumed, so that the capacity of the ink containing section 101 become smaller to some extent, the coil spring 160 biases the pressure receiving plate 112 in a direction resisting displacement by negative pressure. The pressure receiving plate 112 can generate negative pressure in the ink containing section 101 by, for example, an elastic force in which the film resists deformation caused by the consumption of ink, in a state before the pressure receiving plate 112 is biased by the coil spring 160.

C8. Modified Example 8

In the above-described example, as a spring which biases each section, a coil spring is adopted. However, as a configuration to bias each section, other various aspects such as a leaf spring or a resin-made member having flexibility can be adopted.

C9. Modified Example 9

In the above-described example, the ink cartridge 100 is an ink cartridge for a printer which is used for home use or office use. However, the ink cartridge as the liquid container according to the invention can also be applied to an ink cartridge of a large-sized printer which is used for business use.

Also, in the above-described example, the ink jet printer in which a cartridge mounting section reciprocates together with a printing head in the paper width direction of a printing medium (a so-called on-carriage type printer; refer to FIG. 1) has been illustrated. However, the liquid container according to the invention can also be applied to an ink jet printer in which the ink cartridge 100 is installed as a main tank separately from a carriage with a printing head and a sub-tank installed therein (a so-called off-carriage type printer).

C10. Modified Example 10

In the above-described example and modified examples, the ink jet printer and the ink cartridge have been described. However, the invention may be used in a liquid ejecting apparatus that ejects or discharges liquid other than ink and can also be applied to a liquid container containing such liquid. The liquid container according to the invention can be applied to various liquid consumption apparatuses that are each provided with a liquid ejecting head or the like that discharges a minutely small amount of liquid droplet. In addition, the "liquid droplet" describes a liquid in a state of being discharged from the liquid ejecting apparatus and also includes droplets of a granular shape or a tear shape, or droplets tailing into a line. Also, it is acceptable if the "liquid" as mentioned herein is a material that can be ejected by a liquid ejecting apparatus. For example, it is acceptable if the liquid is a substance in state when it is a liquid phase, and the liquid includes not only liquids in a liquid state with high or low viscosity, a flow state such as sol, gel water, other inorganic or organic solvents, a solution, a liquid resin, or a liquid metal (metal melt), and one state of substance, but also a material in which particles of a functional material composed of a solid material such as pigment or metal particles are dissolved, dispersed, or mixed in a solvent, or the like. Also, ink as described in the above-described example, a liquid crystal, or the like can be given as representative examples of the liquid. Here, ink is set to include general water-based ink and oil-based ink and various liquid compositions such as gel ink, hot-melt ink, and the like. As specific examples of the liquid ejecting apparatus, the following can be given: a liquid ejecting apparatus that ejects liquids that include, in a dispersed or dissolved form, materials such as an electrode material or a color material, which is used for the manufacturing or the like of, for example, a liquid crystal display, an EL (electroluminescence) display, a surface-emitting display, or a color filter; a liquid ejecting apparatus that ejects a biological organic matter that is used for the manufacturing of biochips; and a liquid ejecting apparatus that is used as a precision pipette and ejects liquid that is a sample. Further, the following liquid ejecting apparatuses may be adopted: a liquid ejecting apparatus that ejects a pinpoint of lubricant oil to a precision machine such as a clock or a camera; a liquid ejecting apparatus that ejects a transparent resin solution such as ultraviolet curing resin onto a substrate in order to form a minute hemispherical lens (an optical lens) or the like which is used in an optical communication element or the like; and a liquid ejecting apparatus that ejects an etching solution such as an acid or an alkali in order to etch a substrate or the like. Thus, the invention can be applied to any one type of ejecting apparatus among these liquid ejecting apparatuses and the liquid container.

What is claimed is:

1. A liquid container for containing liquid to be supplied to a liquid ejecting apparatus, the container comprising:

a containing section for containing liquid, a liquid delivery section for delivering the liquid to the outside, an air introduction section for introducing external air into the containing section, a deformation section which constitutes a portion of the outer circumference of the containing section and is capable of being deformed, wherein the deformation section includes:

a rigid body section which is not deformed by a reduction in pressure in the inside of the containing section, and a flexible section which is deformed with a reduction in pressure in the inside of the containing section due to the delivery of the liquid, thereby allowing the rigid body section to be displaced in a direction in which the capacity of the containing section is reduced, the liquid container further includes a stop section which at least blocks the displacement equal to or greater than a predetermined amount with respect to a portion of the rigid body section, and in the displacement of the rigid body section accompanying a reduction in the pressure, the air introduction section introduces the air into the containing section by transmission of displacement of the other portion of the rigid body section, the displacement of the portion of which has been blocked.

2. The liquid container according to claim 1, wherein the stop section is configured so as to at least block the displacement equal to or more than the predetermined amount with respect to two points of the rigid body section as the portion of the rigid body section.

3. The liquid container according to claim 2, further comprising:

a wall portion which constitutes the outer circumference of the containing section along with the deformation section, wherein the stop section is provided at the wall portion and provided so as to come into contact with the two points prior to another area of the rigid body section when the two points have been displaced by a predetermined amount, in the displacement of the rigid body section accompanying a reduction in the pressure.

4. The liquid container according to claim 2, wherein the stop section is provided to protrude in the direction of the displacement from the two points of the rigid body section.

5. The liquid container according to claim 2, wherein the rigid body section is in the form of a plate, and the rigid body section, the stop section, and the air introduction section are configured such that the center of gravity of the rigid body section is located in a triangle which is configured by an area of the rigid body section, which comes into contact with another member in order to transmit the displacement to the air introduction section, and the two points.

6. The liquid container according to claim 5, further comprising:

an elastic member which biases the rigid body section in a direction in which the capacity of the containing section increases, wherein the stop section is configured to block the displacement equal to or greater than a predetermined amount which is greater than 0 with respect to the two points, and the rigid body section, the stop section, and the elastic member are configured such that the center of gravity of the rigid body section is on the same side as the two points with respect to the center of an area where the elastic member biases the rigid body section.

7. The liquid container according to claim 2, further comprising:

a detection member for detecting a liquid level of the liquid having fallen below the height of a predetermined detection position, at the predetermined detection position in the containing section when the liquid container is in a state where it is mounted on the liquid ejecting apparatus, wherein the rigid body section, the stop section, and the detection member are configured such that when the liquid container is in a state where it is mounted on the liquid ejecting apparatus, the detection position and the two points are located below an area of the rigid body section, which comes into contact with another member in order to transmit the displacement to the air introduction section, and the detection position is at a position closer to the two points than the area of the rigid body section, which comes into contact with another member, in the height direction.

8. The liquid container according to claim 6, further comprising:

a detection member for detecting a liquid level of the liquid having fallen below the height of a predetermined detection position, at the predetermined detection position in the containing section when the liquid container is in a state where it is mounted on the liquid ejecting apparatus, wherein the rigid body section, the stop section, and the detection member are configured such that when the liquid container is in a state where it is mounted on the liquid ejecting apparatus, the detection position and the two points are located below an area of the rigid body section, which comes into contact with another member in order to transmit the displacement to the air introduction section, and the detection position is at a position closer to the two points than the area of the rigid body section, which comes into contact with another member, in the height direction.

9. The liquid container according to claim 8, wherein the rigid body section, the stop section, the elastic member, and the detection member are configured such that when the liquid container is in a state where it is mounted on the liquid ejecting apparatus, the detection position and the two points are located below the center of the area where the elastic member biases the rigid body section.

10. The liquid container according to claim 6, wherein a first elastic member and a second elastic member in which an elastic force that is exerted on the rigid body section in the same displacement is smaller than that of the first elastic member are provided as the elastic member, wherein the second elastic member biases the rigid body section at a position closer to the two points than the first elastic member.

11. A liquid ejecting apparatus comprising the liquid container according to claim 2.

12. A liquid ejecting apparatus comprising the liquid container according to claim 3.

13. A liquid ejecting apparatus comprising the liquid container according to claim 4.

14. A liquid ejecting apparatus comprising the liquid container according to claim 5.

15. A liquid ejecting apparatus comprising the liquid container according to claim 6.

16. A liquid ejecting apparatus comprising the liquid container according to claim 7.

17. A liquid ejecting apparatus comprising the liquid container according to claim 8.

18. A liquid ejecting apparatus comprising the liquid container according to claim 9.

19. A liquid ejecting apparatus comprising the liquid container according to claim 10.

* * * * *